US009394661B2

(12) United States Patent
White

(10) Patent No.: US 9,394,661 B2
(45) Date of Patent: Jul. 19, 2016

(54) MAINTAINABLE SOIL DRAIN

(71) Applicant: David J. White, Ames, IA (US)

(72) Inventor: David J. White, Ames, IA (US)

(73) Assignee: Ingios Geotechnics, Inc., Boone, IA (US)

( * ) Notice: Subject to any disclaimer, the term of this patent is extended or adjusted under 35 U.S.C. 154(b) by 0 days.

(21) Appl. No.: 14/481,238

(22) Filed: Sep. 9, 2014

(65) Prior Publication Data

US 2015/0071709 A1 Mar. 12, 2015

Related U.S. Application Data

(60) Provisional application No. 61/875,280, filed on Sep. 9, 2013.

(51) Int. Cl.
*E02B 11/00* (2006.01)
*E02D 3/00* (2006.01)

(52) U.S. Cl.
CPC ..... *E02B 11/005* (2013.01); *E02D 3/00* (2013.01)

(58) Field of Classification Search
CPC ..... E02B 11/005
USPC ..... 405/36, 43–45, 49, 50
See application file for complete search history.

(56) References Cited

U.S. PATENT DOCUMENTS 4,589,447 A * 5/1986 Kane ..... E03F 3/06 138/98

FOREIGN PATENT DOCUMENTS

| | | | |
|---|---|---|---|
| CN | 201305853 | * | 9/2009 |
| JP | 2-136418 | * | 5/1990 |
| JP | 10183638 A | * | 7/1998 |
| JP | 11140891 A | * | 5/1999 |
| JP | 11140891 A | * | 5/1999 |

OTHER PUBLICATIONS

Machine Translation of Japanese doucment JP 11-140891, dated Jun. 28, 2015.*

* cited by examiner

*Primary Examiner* — Sunil Singh
(74) *Attorney, Agent, or Firm* — Olive Law Group, PLLC

(57) ABSTRACT

A maintainable soil drain and methods for using the maintainable soil drain for draining liquid away from structures, such as Mechanically Stabilized Earth (MSE) walls and earth slopes, are disclosed. According to an aspect, a maintainable soil drain includes a drainage pipe having multiple holes defined therein. The maintainable soil drain also includes a removable drain. Further, the maintainable soil drain includes an interior geotextile wrapping that substantially surrounds the removable drain.

19 Claims, 5 Drawing Sheets

MAINTAINABLE SOIL DRAIN

CROSS REFERENCE TO RELATED APPLICATION

This application claims the benefit of U.S. provisional patent application No. 61/875,280, filed Sep. 9, 2013, the content of which is hereby incorporated herein by reference in its entirety.

TECHNICAL FIELD

The presently disclosed subject matter relates generally to a maintainable soil drain.

BACKGROUND

It is well known that stability of structures, such as earth slopes and retaining walls, are negatively affected by water pressure resulting from poor drainage. Many failures have occurred requiring costly rework ranging from complete to partial excavation and/or trenching to install tiling and French drains, for example.

Perforated, slotted or slope drains typically are plastic drainage pipes that have perforations to allow liquid to drain away from an area. Many current drains in the art get plugged due to sediment and debris falling through the perforations of the drain. In some cases, the perforated drains are covered with a fine exterior filter fabric to prevent the movement of soil and other debris from the exterior of the drain to the interior of the drain during conditions of flow. A disadvantage of this system is that the fine fabric tends to get clogged over time resulting in a drain that does not work as intended.

Prefabricated vertical (PV) drains or Wick drains typically comprise a plastic core surrounded by a fine filter fabric. These drains are usually used on earth slopes, but they also tend to clog over time.

For at least the foregoing reasons, there is a need for improved systems and techniques for improving drainage to maintain structure stability.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

The presently disclosed subject matter relates generally to a perforated drain. More particularly, the presently disclosed subject matter provides a perforated drainage pipe having a removable insert. The pipe may be installed in a structure, such as a retaining wall or an earth slope, to drain liquid away from the area to increase the factor of safety against sliding.

According to an aspect, the presently disclosed subject matter provides a maintainable soil drain comprising: a) a perforated drainage pipe; b) a removable and replaceable interior drain; and c) an interior geotextile wrapping surrounding the removable drain. In certain aspects, there is an exterior geotextile wrapping surrounding the perforated drainage pipe.

In another aspect, the presently disclosed subject matter provides a method for draining liquid away from a Mechanically Stabilized Earth (MSE) wall, the method may include placing a maintainable soil drain of the presently disclosed subject matter into a MSE wall. One end of the drain may be open to the outside of the wall to allow drainage to occur.

In other aspects, the presently disclosed subject matter provides a method for inserting a maintainable soil drain of the presently disclosed subject matter into an earth slope. One end of the drain may be open to the outside of the earth slope to allow drainage to occur.

Accordingly, it is an object of the presently disclosed subject matter to provide a method and apparatus for the installation of a soil drain that can be maintained over time so that clogging of the drain does not occur or is substantially limited.

A further object of the presently disclosed subject matter is to provide a method and a maintainable apparatus for draining liquid away from an MSE wall. In some embodiments, draining the liquid away from the MSE wall can result in stabilization of the wall.

Another object of the presently disclosed subject matter is to provide a method and maintainable apparatus for draining liquid away from an earth slope. In some embodiments, draining the liquid away from the earth slope results in stabilization of the earth slope.

Still another object of the presently disclosed subject matter is to provide a cost effective and maintainable drainage technology over the service life of a structure, such as a retaining wall or an earth slope.

Certain aspects of the presently disclosed subject matter having been stated hereinabove, which are addressed in whole or in part by the presently disclosed subject matter, other aspects will become evident as the description proceeds when taken in connection with the accompanying Examples and Figures as best described herein below.

BRIEF DESCRIPTION OF THE DRAWINGS

The foregoing summary, as well as the following detailed description of preferred embodiments, is better understood when read in conjunction with the appended drawings. For the purposes of illustration, there is shown in the drawings exemplary embodiments; however, the present disclosure is not limited to the specific methods and instrumentalities disclosed. In the drawings.

DETAILED DESCRIPTION

Figure 1:
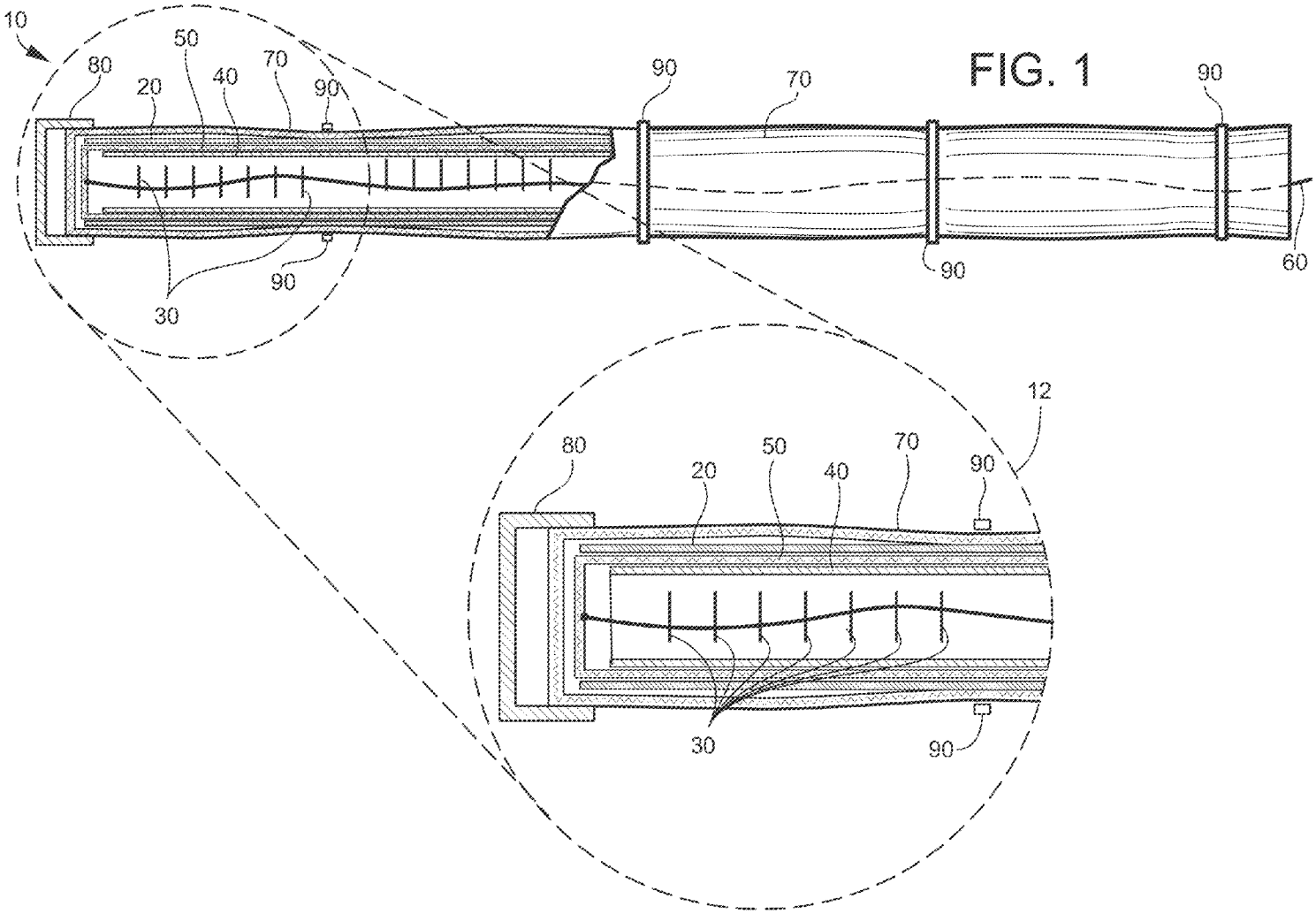
FIG. 1 is a partial cross-sectional, side view of an example maintainable soil drain having an interior removable drain in accordance with embodiments of the presently disclosed subject matter.

The presently disclosed subject matter now will be described more fully hereinafter with reference to the accompanying Figures, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Figures. Therefore, it is to be understood that the presently disclosed subject matter is not to be limited to the specific embodiments disclosed and that modifications and other embodiments are intended to be included within the scope of the appended claims.

The presently disclosed subject matter provides a method and apparatus for the installation of a maintainable soil drain. In some embodiments, the maintainable soil drain is a push-in pipe drain with a replaceable filter system, as described hereinbelow. In other embodiments, the drainage system can be buried or pushed into a substantially horizontal position into the ground.

Accordingly, in some embodiments, the presently disclosed subject matter provides a maintainable soil drain including a perforated drainage pipe. The pipe may include multiple holes defined therein along its length. Further, the maintainable soil drainage may include a removable drain. The maintainable soil drain may also include an interior geotextile wrapping surrounding the removable drain. In other embodiments, the interior geotextile wrapping or replaceable/removable geotextile filter is partly expanded diametrically via a smaller diameter removable drain and/or incrementally spaced keepers (e.g., like plastic rebar positions devices) or a coil. In further embodiments, the interior geotextile wrapping and removable drain is designed to be removed, cleaned, and/or replaced as part of routine maintenance. In still further embodiments, maintenance operations are completed by a laborer with small equipment and tools to pull, clean and/or replace the removable drain and interior geotextile wrapping.

Because the interior geotextile wrapping can be removed periodically, it does not need to be coarse. Accordingly, in some embodiments, the interior geotextile wrapping can be made of a fine material so it can prevent soil and/or debris from entering the removable drain and clogging the removable drain. For example, the interior geotextile wrapping can be manufactured for preventing particles smaller than 0.075 mm from passing through. In other embodiments, there may be situations where it may be desirable for the interior geotextile wrapping to be made from a coarse material. For example, in these embodiments the interior geotextile wrapping can allow particles as large as 0.425 mm to pass through.

In accordance with embodiments, the maintainable soil drain can include an exterior geotextile wrapping that is positioned to surround the perforated drainage pipe. In some embodiments, the exterior geotextile wrapping can be coarse so that it can prevent some soil and debris from entering the perforated drainage pipe. Such wrappings can make it less likely for the drain to clog over its service life.

The perforated drainage pipe and the removable drain can have any size and shape perforations that can allow fluid to flow into the drainage pipe. In some embodiments, the perforations are slotted. In other embodiments, the perforations are about ⅛ inch wide. In still other embodiments, the perforations are about 1 inch long. The perforations can be of any suitable size and dimension.

In some embodiments, the perforated drainage pipe and the removable drain comprise at least one man-made material. In other embodiments, the perforated drainage pipe and the removable drain comprise at least one natural material. In still other embodiments, the perforated drainage pipe and removable drain comprise at least one material selected from the group consisting of polymer, fiber, polyvinyl chloride (PVC), polyethylene, high density polyethylene (HDPE), steel, galvanized steel, stainless steel, the like, or combinations thereof.

In some embodiments, the length of the perforated drainage pipe can be any suitable length. For example, the length can be between about one foot and about forty feet. In other embodiments, the length of the perforated drainage pipe can be between about three feet and about ten feet. In still other embodiments, the diameter of the perforated drainage pipe can be any suitable length. For example, the diameter can be between about 1 inch and about 8 inches. In further embodiments, the diameter of the perforated drainage pipe can be between about 3 and about 4 inches.

As used herein, a "geotextile wrapping" refers to a permeable fabric which, when used in association with soil, has the ability to separate, filter, reinforce, protect, and/or drain. In some embodiments, the geotextile wrapping can be made from polypropylene, polyester, or any other suitable material. In other embodiments, the geotextile wrapping can be woven, needle punched, heat bonded, or otherwise suitably manufactured. In particular embodiments, the geotextile wrapping may be non-woven.

In some embodiments, the interior geotextile wrapping can be made from one or more fabrics selected from the group consisting of polypropylene, polyester, or the like. In other embodiments, the exterior geotextile wrapping can be made from one or more fabrics selected from the group consisting of polypropylene, polyester, or the like.

In some embodiments, the presently disclosed maintainable soil drain further comprises a pull mechanism for removal of the removable drain. In other embodiments, the pull mechanism is a wire or string attached to the removable drain. Alternatively, the pull mechanism can be any other suitable mechanism for removal of the drain.

FIG. 1 illustrates a partial cross-sectional, side view of an example maintainable soil drain 10 having an interior removable drain in accordance with embodiments of the presently disclosed subject matter. The figure also illustrates a cross-sectional, side magnified view 12 of an end of the maintainable soil drain. Referring to FIG. 1, the maintainable soil drain 10 can include a drainage pipe 20 with perforations or holes 30 defined therein, a removable drain 40, and an interior geotextile wrapping 50 surrounding the removable drain 40. The drainage pipe 20 may optionally have perforations or holes. The removable drain 40 may also have multiple perforations or holes. The perforations 30 may extend from an exterior of the pipe 20 to the interior of the pipe 20. The perforations 30 may be of any suitable size, dimension, or shape.

In accordance with embodiments, the interior geotextile wrapping 50 (indicated by broken lines) may substantially or completely surround the removable drain 40. In other embodiments, the interior geotextile wrapping 50 may only partially surround the removable drain 40. The interior geotextile wrapping 50 may be positioned between the drainage pipe 20 and the removable drain 40.

In accordance with embodiments, the removable drain 40 may be operatively configured with a pull mechanism 60 for permitting the removal of the removable drain 40 from the drainage pipe 20. In some embodiments, the pull mechanism 60 can be a non-biodegradable pull wire, string, or other suitable mechanism that can be used by an operator to also pull out the interior geotextile wrapping 50 from the drainage pipe 20. In other embodiments, the pull mechanism is used to maintain the presently disclosed drain as part of a regular maintenance operation, where a new interior geotextile wrapping can be placed by pushing in a new interior geotextile wrapping via the interior pipe/keeper system.

In accordance with embodiments, the maintainable soil drain 10 may include an exterior geotextile wrapping 70 that may partially, substantially, or completely surround the perforated drainage pipe 20. The exterior geotextile wrapping 70 may function as a filter and may be suitably attached or held to the exterior of the perforated drainage pipe 20. In some embodiments, the exterior geotextile wrapping 70 can be oversized such that the width of the geotextile wrapping is greater than the circumference of the perforated drainage pipe, allowing for overlapping wrinkles to increase the drainage surface area of the geotextile wrapping.

The maintainable soil drain 10 may include a sacrificial oversized shoe or end cap 80 to secure or hold the exterior geotextile wrapping 70 in place. The end cap 80 may include one or more holes or perforations for easing the friction/adhesion during installation of the maintainable soil drain 10 (e.g., push-in application).

In accordance with embodiments, the maintainable soil drain 10 may comprise one or more mechanisms for securing or holding the exterior geotextile wrapping 70 in place during installation. Example mechanisms include, but are not limited to, straps, adhesive, bands, zip-ties, wire, and the like. For example, FIG. 1 shows multiple straps 90 to secure the geotextile wrapping.

Figure 2:
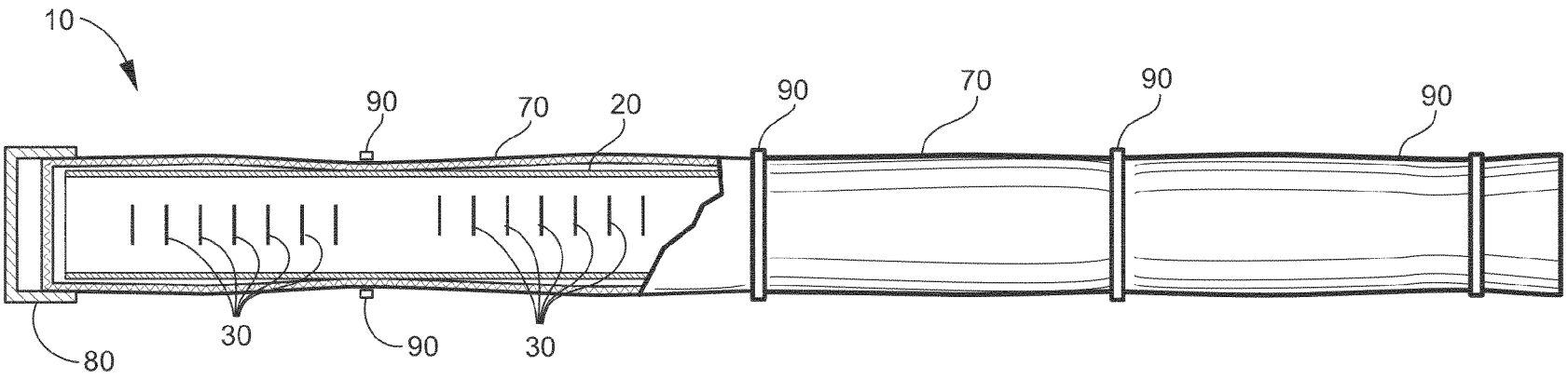
FIG. 2 is a cross-sectional side view of another example maintainable soil drain that does not include an interior removable drain in accordance with embodiments of the presently disclosed subject matter.

In accordance with embodiments of the present disclosure, FIG. 2 illustrates a cross-sectional side view of another example maintainable soil drain 10 that does not include an interior removable drain. Referring to FIG. 2, the maintainable soil drain 10 does not include a removable drain. The maintainable soil drain 10 in this example includes a coarse geotextile wrapping 70 that allows the drain to work for a long period of time without clogging of the geotextile wrapping 70. The straps 90 can hold the geotextile wrapping 70 in position with respect to the perforated drainage pipe 20.

Figure 3A:
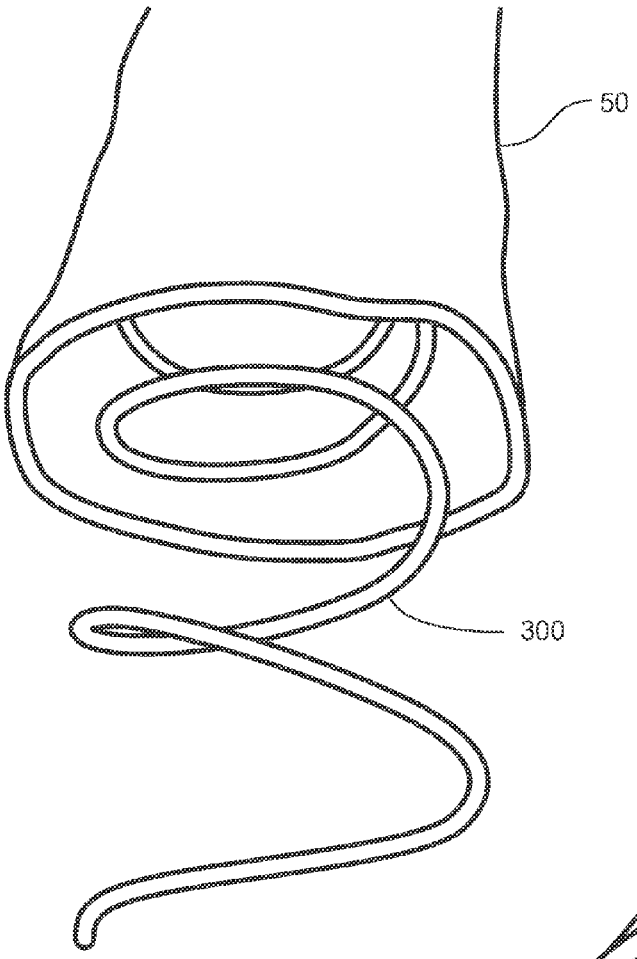
FIG. 3A is a top perspective view of a coil for holding the interior geotextile wrapping in accordance with embodiments of the present subject matter.
Figure 3B:
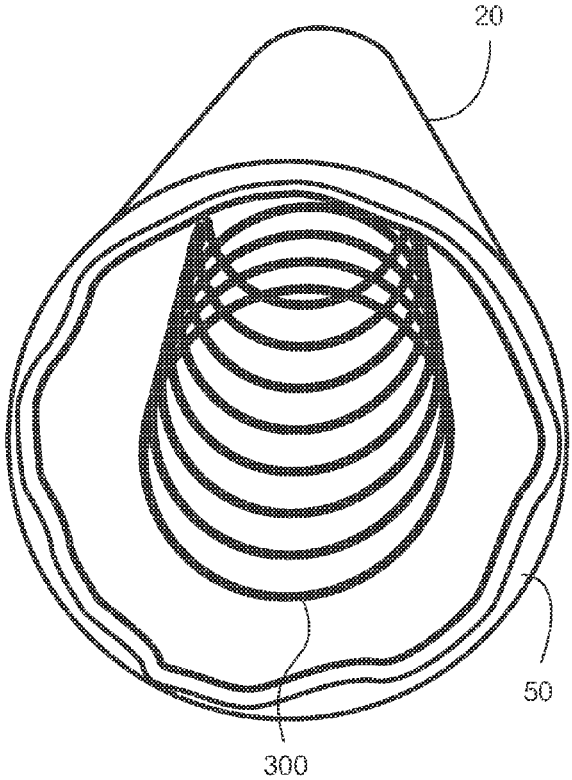
FIG. 3B is an end view of the interior geotextile wrapping and coil positioned within a perforated drainage pipe in accordance with embodiments of the present subject matter.
Figure 3C:
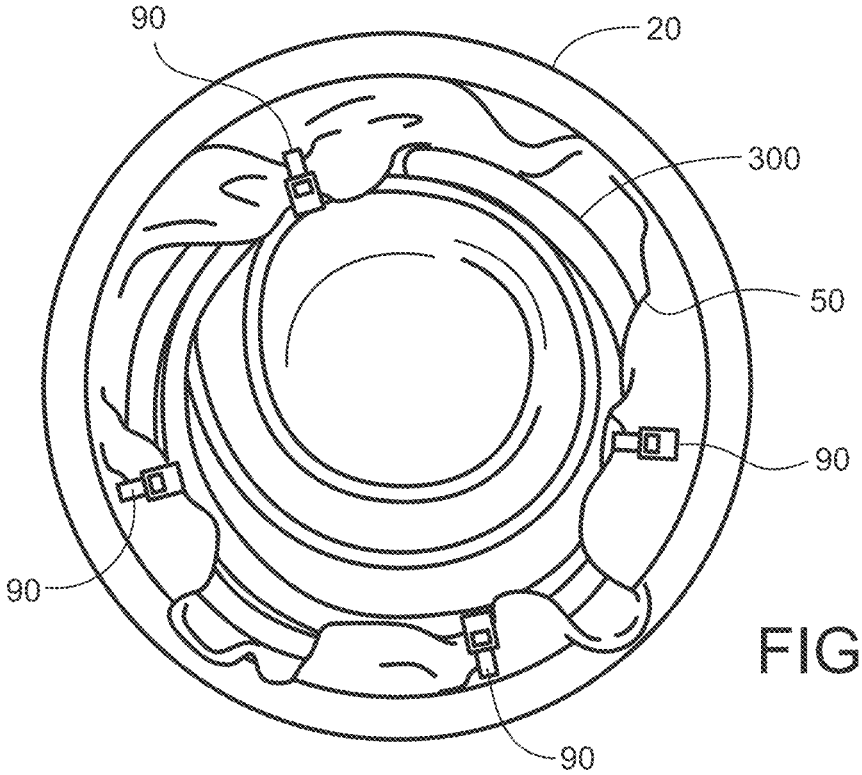
FIG. 3C illustrates another end view of an example interior geotextile wrapping and coil positioned within a perforated drainage pipe in accordance with embodiments of the present disclosure.

In accordance with embodiments, a maintainable soil drain may function as an interior housing for holding the interior geotextile wrapping. For example, FIG. 3A illustrates a top perspective view of a coil 300 for holding the interior geotextile wrapping 50 in accordance with embodiments of the present subject matter. In operation, the coil 300 may replace a removable drain in a maintainable soil drain, such as the removable drain 40 of the maintainable soil drain 10 shown in FIG. 1. It is noted that the removable drain 40 and the coil 300 may be replaced within the maintainable soil drain by any other suitable rigid or semi-rigid structure extending all of substantially the length of the maintainable soil drain. The structure may include one or more perforations or other passageways from its exterior to its interior. FIG. 3B illustrates an end view of the interior geotextile wrapping 50 and coil 300 positioned within a perforated drainage pipe 20. FIG. 3C illustrates another end view of an example interior geotextile wrapping 50 and coil 300 positioned within a perforated drainage pipe 20 in accordance with embodiments of the present disclosure.

The presently disclosed soil drain can be used in a structure, such as a wall or an earth slope, to drain liquid away from the structure. In some embodiments, draining the liquid away from the structure helps to stabilize the structure. In other embodiments, the presently disclosed soil drain is inserted or placed into the structure such that the drain is about horizontal in relation to the ground surface. In some other embodiments, the presently disclosed soil drain is inserted or placed into the structure so that it is not horizontal with the ground surface, such as relatively diagonal with the ground surface, about vertical with the ground surface, or any other angle, depending on the requirements of the site and the structure.

Figure 4A:
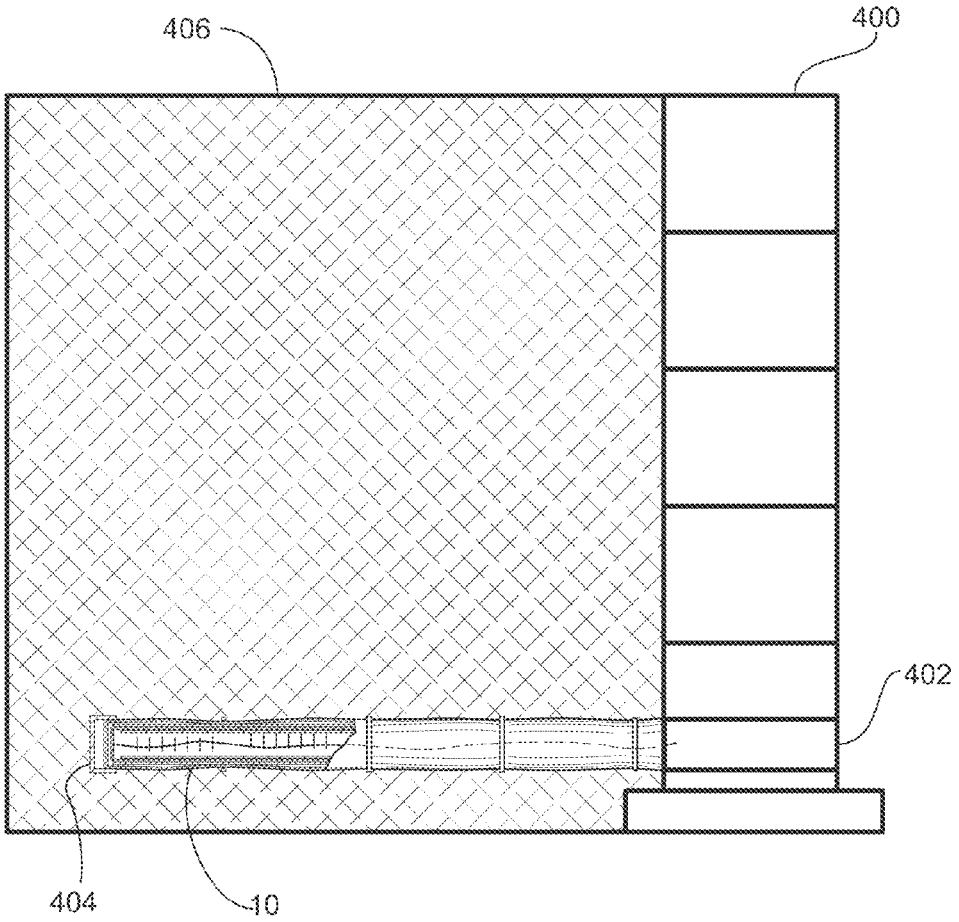
FIG. 4A is a cross-sectional side view of example placement of a maintainable soil drain within an MSE wall in accordance with embodiments of the present subject matter.

In accordance with embodiments, FIG. 4A illustrates a cross-sectional side view of example placement of a maintainable soil drain 10 within an MSE wall 400. Referring to FIG. 4A, the maintainable soil drain 10 can extend through the MSE wall 400. An end 402 of the maintainable soil drain 10 may allow for drainage of liquid. The cap 80 is located at an opposing end 404 of the maintainable soil drain 10. A portion of the maintainable soil drain 10 extends through the retained soil structure 406.

Figure 4B:
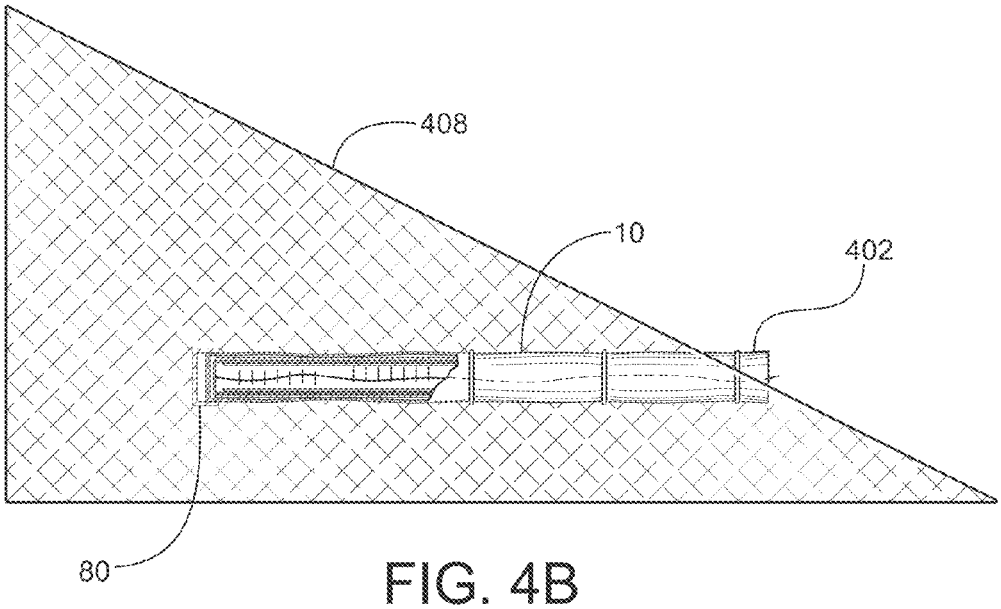
FIG. 4B is a cross-sectional side view of example placement of a maintainable soil drain within an earth slope in accordance with embodiments of the present subject matter.

In accordance with embodiments, FIG. 4B illustrates a cross-sectional side view of example placement of a maintainable soil drain 10 within an earth slope 408. Referring to FIG. 4B, the maintainable soil drain 10 can extend through the earth slope 408. An end 402 of the maintainable soil drain 10 may allow for drainage of liquid.

In some embodiments, installation of the presently disclosed drain is accomplished by burying the pipe during normal construction operations. In other embodiments, the presently disclosed drain is pushed in using an excavator with a steel mandrel after construction is complete. In still other embodiments, the excavator fits on the interior of the maintainable soil drain.

In some embodiments, the presently disclosed subject matter provides a method for draining liquid away from an MSE wall, the method comprising: placing a maintainable soil drain of the presently disclosed subject matter into a MSE wall during construction of the wall, whereby one end of the drain is open to the outside of the wall to allow drainage to occur. In other embodiments, the maintainable soil drain is positioned about horizontal in relation to the ground and one end of the drain is open to the outside of the wall to allow drainage to occur.

MSE walls stabilize unstable slopes and retain the soil on steep slopes and under crest loads. The wall face is often of precast, segmental blocks, panels or geocells that can tolerate some differential movement. In other embodiments, the presently disclosed methods increase the stability of the MSE wall.

In some embodiments, the presently disclosed subject matter provides a method for draining liquid away from an earth slope, the method comprising: inserting a maintainable soil drain of the presently disclosed subject matter into an earth slope, whereby one end of the drain is open to the outside of the earth slope to allow drainage to occur. In other embodiments, the maintainable soil drain is about horizontal in relation to the ground. In still other embodiments, the presently disclosed methods increase the stability of the earth slope.

Although the foregoing subject matter has been described in some detail by way of illustration and example for purposes of clarity of understanding, it will be understood by those skilled in the art that certain changes and modifications can be practiced within the scope of the appended claims.

What is claimed:

1. A maintainable soil drain comprising:

a drainage pipe having a plurality of holes defined therein, and defining an interior space extending between ends of the drainage pipe;

an end cap attached to and at least substantially covering one end of the drainage pipe;

a removable drain positioned in the interior space of the drainage pipe and defining a substantially hollow interior and a plurality of holes extending to the interior, the removable drain includes a first end and a second end that opposes the first end, the second end defining an opening;

a pull wire extending between the first end and the second end of the removable drain, wherein the pull wire has a first end and a second end, the first end of the pull wire being attached to the first end of the removable drain, and the second end of the pull wire being positioned adjacent the opening of the second end of the removable drain; and an interior geotextile wrapping that substantially surrounds the removable drain.

2. The maintainable soil drain of claim 1, further comprising an exterior geotextile wrapping that substantially surrounds the drainage pipe.

3. The maintainable soil drain of claim 2, wherein the exterior geotextile wrapping comprises a coarse material.

4. The maintainable soil drain of claim 2, wherein the exterior geotextile wrapping is made of one of polypropylene and polyester.

5. The maintainable soil drain of claim 1, wherein the drainage pipe and the removable drain each comprise at least one man-made material.

6. The maintainable soil drain of claim 1, wherein the drainage pipe and the removable drain each comprise at least one natural material.

7. The maintainable soil drain of claim 1, wherein the drainage pipe and removable drain each comprise at least one of polymer, fiber, polyethylene, high density polyethylene (HDPE), steel, galvanized steel, and stainless steel.

8. The maintainable soil drain of claim 1, wherein the drainage pipe is between about one foot and about forty feet in length.

9. The maintainable soil drain of claim 1, wherein a diameter of the drainage pipe is between about 1 inch and about 8 inches.

10. The maintainable soil drain of claim 1, wherein the interior geotextile wrapping is a fabric made from at least one of polypropylene and polyester.

11. The maintainable soil drain of claim 1, wherein the pull wire comprises one of a wire or string attached to the removable drain.

12. The maintainable soil drain of claim 1, wherein the removable drain comprises a coil.

13. A method for draining liquid away from a Mechanically Stabilized Earth (MSE) wall, the method comprising:

providing a maintainable soil drain comprising:

a drainage pipe having a plurality of holes defined therein, and defining an interior space extending between ends of the drainage pipe;

an end cap attached to and at least substantially covering one end of the drainage pipe;

a removable drain positioned in the interior space of the drainage pipe and defining a substantially hollow interior and a plurality of holes extending to the interior, the removable drain includes a first end and a second end that opposes the first end, the second end defining an opening;

a pull wire extending between the first end and the second end of the removable drain, wherein the pull wire has a first end and a second end, the first end of the pull wire being attached to the first end of the removable drain, and the second end of the pull wire being positioned adjacent the opening of the second end of the removable drain; and an interior geotextile wrapping that substantially surrounds the removable drain; and placing the maintainable soil drain into an MSE wall such that one end of the maintainable soil drain is open to the outside of the wall for allowing drainage to occur.

14. The method of claim 13, wherein the maintainable soil drain is positioned about horizontal in relation to the ground.

15. The method of claim 13, wherein the insertion of the maintainable soil drain increases the stability of the MSE wall.

16. The method of claim 13, wherein the pull wire comprises one of a wire or string attached to the removable drain.

17. A method for draining liquid away from an earth slope, the method comprising:

providing a maintainable soil drain comprising:

a drainage pipe having a plurality of holes defined therein, and defining an interior space extending between ends of the drainage pipe;

an end cap attached to and at least substantially covering one end of the drainage pipe;

a removable drain positioned in the interior space of the drainage pipe and defining a substantially hollow interior and a plurality of holes extending to the interior, the removable drain includes a first end and a second end that opposes the first end, the second end defining an opening;

a pull wire extending between the first end and the second end of the removable drain, wherein the pull wire has a first end and a second end, the first end of the pull wire being attached to the first end of the removable drain, and the second end of the pull wire being positioned adjacent the opening of the second end of the removable drain; and an interior geotextile wrapping that substantially surrounds the removable drain; and inserting the maintainable soil drain into an earth slope such that one end of the maintainable soil drain is open to the outside of the earth slope for allowing drainage to occur.

18. The method of claim 17, wherein the maintainable soil drain is positioned about horizontal in relation to the ground.

19. The method of claim 17, wherein the insertion of the maintainable soil drain increases the stability of the earth slope.

* * * * *